US011186913B2

(12) United States Patent
Badger, II

(10) Patent No.: US 11,186,913 B2
(45) Date of Patent: Nov. 30, 2021

(54) CORROSION INHIBITOR AND WATER CONDITIONING AGENT

(71) Applicant: Illinois Tool Works Inc., Glenview, IL (US)

(72) Inventor: Steven Michael Badger, II, Eldridge, IA (US)

(73) Assignee: ILLINOIS TOOL WORKS, Glenview, IL (US)

( * ) Notice: Subject to any disclaimer, the term of this patent is extended or adjusted under 35 U.S.C. 154(b) by 282 days.

(21) Appl. No.: 15/773,085

(22) PCT Filed: Aug. 26, 2016

(86) PCT No.: PCT/US2016/048861

§ 371 (c)(1),
(2) Date: May 2, 2018

(87) PCT Pub. No.: WO2017/078832

PCT Pub. Date: May 11, 2017

(65) Prior Publication Data

US 2020/0165731 A1 May 28, 2020

Related U.S. Application Data

(60) Provisional application No. 62/250,932, filed on Nov. 4, 2015.

(51) Int. Cl.

| | |
|---|---|
| ***C23F 11/18*** | (2006.01) |
| ***C23C 22/62*** | (2006.01) |
| ***C23C 22/68*** | (2006.01) |
| ***C23F 11/06*** | (2006.01) |

(52) U.S. Cl.
CPC ..... *C23F 11/184* (2013.01); *C23C 22/62* (2013.01); *C23C 22/68* (2013.01); *C23F 11/06* (2013.01)

(58) Field of Classification Search
CPC ..... C23F 11/184; C23F 11/06; C23C 22/62; C23C 22/68
See application file for complete search history.

(56) References Cited

U.S. PATENT DOCUMENTS

| | | | | |
|---|---|---|---|---|
| 3,961,991 | A * | 6/1976 | Yoshida | C23C 22/08 148/254 |
| 3,973,056 | A | 8/1976 | Fessler et al. | |
| 4,152,176 | A * | 5/1979 | Guhde | C23C 22/80 106/436 |
| 4,929,425 | A | 5/1990 | Hoots et al. | |
| 2006/0043341 | A1 | 3/2006 | Trahan et al. | |
| 2014/0360943 | A1 | 12/2014 | Aulick et al. | |
| 2018/0142360 | A1 * | 5/2018 | Park | C23G 1/24 |

FOREIGN PATENT DOCUMENTS

| | | | |
|---|---|---|---|
| CN | 1347848 | A | 5/2002 |
| CN | 1614408 | A | 5/2005 |
| CN | 1676669 | A | 10/2005 |
| CN | 101445922 | A | 6/2009 |
| CN | 101660162 | A | 3/2010 |
| CN | 102465300 | A | 5/2012 |
| CN | 103183417 | A | 7/2013 |
| GB | 1519303 | A | 7/1978 |
| JP | S57-120678 | A | 7/1982 |
| RU | 2535891 | C1 | 12/2014 |
| WO | 9608588 | A1 | 3/1996 |
| WO | 9958164 | A1 | 11/1999 |

OTHER PUBLICATIONS

International Search Report dated Nov. 21, 2016 for International Application No. PCT/US2016/048861 filed Aug. 26, 2016.
Lu Zhili, et al., "Pilot Study on the Control of Iron Release in Pipe Network by Phosphorus-Silicon Complex Corrosion Inhibitor", Jan. 10, 2015, pp. 150-155, vol. 41, No. 1 of "Water & Wastewater Engineering".
Chinese first office action (Original and Translated copies) dated Nov. 26, 2019 in Chinese Application No. 201680076974.5.

* cited by examiner

*Primary Examiner* — Andrew J. Oyer
(74) *Attorney, Agent, or Firm* — Blue Filament Law PLLC

(57) ABSTRACT

A composition with corrosion inhibiting properties is provided that includes a first phosphate salt of at least one of trimetaphosphate, hexametaphosphate, or tripolyphosphate. A second phosphate salt of at least one of a disodium phosphate and tetrasodium pyrophosphate is also present with the first phosphate salt present in a weight ratio relative to the second phosphate salt of from 1-4:1. Upon dissolution from 0.1 to 5 total weight percent in a solvent a corrosion inhibiting solution results that is well suited for usage as a water conditioner in cooling systems. A process of protecting an iron containing metal from corrosion is also provided that includes exposing the metal to the solution. The corrosion of the metal over time is monitored to assure the protection of the metal.

8 Claims, No Drawings

CORROSION INHIBITOR AND WATER CONDITIONING AGENT

RELATED APPLICATIONS

This application claims priority benefit of U.S. Provisional Application Ser. No. 62/250,932 filed 4 Nov. 2015; the contents of which are hereby incorporated by reference.

FIELD OF THE INVENTION

The present invention relates in general to corrosion inhibition and in particular to a combination of phosphate compounds to afford superior ferrous corrosion inhibition compared to each such compound alone.

BACKGROUND OF THE INVENTION

Sodium tetraborate, known in mineral form as borax, is a common major component in variety of products such as corrosion inhibitors, magnetic powders, and water conditioners. Borax has recently fallen out of favor for these various applications.

Other prior art products are based on a combination of sodium tripolyphosphate (STPP), present at less than 70 total weight percent and tetrasodium pyrophosphate present at less than 5 total weight percent. While precluding borax, the pH of such products is between 8 and 10.5 upon dilution to 1 total weight percent in deionized water. Cast iron is prone to rust under these conditions. At lower concentrations, it is expected that the rate of oxidative rusting will be even more pronounced. Even with addition of sodium carbonate, the resulting solution is not as effective in rust control as borax.

Solutions which are too high in alkalinity can cause dermatitis. In general, as the alkalinity of an aqueous solution increases, so do the chances of contracting topical exposure dermatitis. A solution of high alkalinity can quickly neutralize naturally occurring skin acidity and cause dermatitis. A pH of 8.5-9.0 in a fully dilution corrosion inhibitor is desirable to reduce the likelihood of topical exposure dermatitis. However, as the amount of alkalinity decreases, the common wisdom is that so does the level of corrosion protection. A balance between corrosion protection and potential for dermatitis needs to be reached.

Thus, there exists a need for a composition that affords the corrosion inhibition of borax without the regulatory concerns or the pH values when diluted in aqueous solution that are prone to induce topical contact dermatitis. There also exists such a composition for usage as a water conditioner in cooling systems.

SUMMARY OF THE INVENTION

A composition with corrosion inhibiting properties is provided that includes a first phosphate salt of at least one of trimetaphosphate, hexametaphosphate, or tripolyphosphate. A second phosphate salt of at least one of a disodium phosphate and tetrasodium pyrophosphate is also present with the first phosphate salt present in a weight ratio relative to the second phosphate salt of from 1-4:1. Upon dissolution from 0.1 to 5 total weight percent in a solvent a corrosion inhibiting solution results that is well suited for usage as a water conditioner in cooling systems. A process of protecting an iron containing metal from corrosion is also provided that includes exposing the metal to the solution. The corrosion of the metal over time is monitored to assure the protection of the metal.

DETAILED DESCRIPTION OF THE PREFERRED EMBODIMENTS

The present invention has utility as a corrosion inhibitor and water conditioner upon dilution in an aqueous solution. The present invention provides better corrosion protection at a lower pH than conventional borax-free compositions. This is accomplished through a synergy between two phosphate components that are present in a concentrate with at least 40 total weight percent of the components, resulting in the phosphate salts when diluted to 1 total weight percent in water to form an aqueous solution has a pH of less than 10.0; and in some embodiments, a pH of between 9.2 and 9.8. In contrast to conventional phosphate based anti-corrosives, the present invention inhibits dermatitis. In addition to being used alone as a corrosion inhibitor, the present invention is suitable as a replacement for conventional corrosion inhibitors in a variety of products that illustratively dry mix formulas of fluorescent magnetic powders, water conditioners, water-based penetrants, aqueous developers and removers, aqueous cleaning products, water-dilutable metalworking fluids and corrosion inhibitors.

In some inventive embodiments, a composition satisfies the requirements of SAE Aerospace Standard 4792 Rev. A. This standard is titled "Water Conditioning Agents for Aqueous Magnetic Particle Inspection" of which Section 3.5.1.3 as to basicity states "Solution shall exhibit a pH of 7.0-10."

As used herein, the term "salt" defines the reaction product of a neutralization reaction of an acid and abase. As used herein the term is intended to encompass hydrates and anhydrous forms of such ionic reaction products, unless otherwise specified. For the purposes of determining a weight percent of salts in the present invention, the weight of water of hydration is not counted towards the weight of a given salt.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

A first phosphate salt is a disodium phosphate or a tripolyphosphate, or a combination thereof. The cation of the first phosphate salt is an alkali metal cation or an alkali earth cation. Cations operative herein illustratively include sodium, potassium, calcium, or a combination thereof. In certain inventive embodiments, the first phosphate salt is only sodium tripolyphosphate.

A second phosphate salt is a divalent phosphate or tetravalent pyrophosphate. The cation of the second phosphate salt is an alkali metal cation or an alkali earth cation. Cations operative herein illustratively include sodium, potassium, calcium, ammonium, or a combination thereof. In certain inventive embodiments, the second phosphate salt is disodium phosphate with the proviso that the first phosphate is sodium tripolyphosphate, dipotassium phosphate, diammonium phosphate, tetrasodium pyrophosphate, tetrapotassium pyrophosphate, or combinations thereof. In still another inventive embodiment, the second phosphate salt is only disodium phosphate anhydrous or a hydrate thereof. In other inventive embodiments, the second phosphate salt is tetrasodium pyrophosphate, tetrapotassium pyrophosphate, or a combination thereof.

According to the present invention, the first phosphate salt is present in a weight ratio relative to said second phosphate salt of from 1-4:1 such that the first phosphate salt and said second phosphate salt. The concentrate has the two salts present are in an amount of from 90 to 100 total weight percent of a concentrate or the dried residue of an aqueous solution. Such that an aqueous solution of the inventive composition dissolved at 1% by weight in deionized water has a pH of between 9.5 and 9.8. It is appreciated that the phosphate salt concentrate can be added to conventional products to provide corrosion inhibition.

An optional additive is present from 0 to 60 total weight percent of the concentrate. Additives operative herein illustratively include sodium silicate, a metal chloride, ceramic silicates, silicas, polymers, pH buffers, surfactants, defoamers, biocides, and combinations thereof with the proviso that the total amount of such additives is less than 60 total dry weight percent.

Sodium silicate, if present, is used in some inventive embodiments in an amount of between 0.5 and 20 dry weight percent.

Metal chlorides operative herein illustratively include substrate protectant salts such as zinc chloride, magnesium chloride, and combinations thereof. In some embodiments, the metal chloride, if present, is used in some inventive embodiments in an amount of between 0.1 and 14 dry weight percent. It is appreciated that zinc chloride applied in combination with, or after sodium silicate results in a zinc silicate protective coating formation.

Ceramic silicates operative herein illustratively include zirconium silicate, magnesium silicates, and combinations thereof. In some embodiments, the ceramic silicate, if present, is used in some inventive embodiments in an amount of between 0.01 and 3 dry weight percent of a solution.

Silicas operative herein illustratively include fumed silica, silicon dioxide, amorphous silica, alumina-silicates, and combinations thereof. In some embodiments, the silica, if present, is used in some inventive embodiments in an amount of between 0.3 and 60 dry weight percent of the concentrate. It is appreciated that silicas are well suited to control viscosity and improve thermal resistance.

Polymers operative herein illustratively include polyethylene powder, polyamides, tetrafluoroethylene polyester, and combinations thereof. In some embodiments, the polymer, if present, is used in some inventive embodiments in an amount of between 1 and 20 dry weight percent.

Biocides and defoamers operative in the present invention are only limited by compatibility and solubility in the aqueous solutions. Typical loading of biocides and defoamers, if present, range from 0.01 to 5 dry weight percent and from 0.5 to 5 dry weight percent, respectively.

Still other additives include pigments added to provide color. Pigments operative herein illustratively include oxides, sulfides, selenides, sulfates of various metals such as iron, cobalt, tin, manganese, and combinations thereof. In some embodiments, the pigment, if present, is used in some inventive embodiments in an amount of between 0.1 and 60 dry weight percent. It is appreciated that magnetic particles or other inert fillers can be present and considered as a coloring pigment additive.

Surfactants operative herein illustratively include nonionic surfactants such as alkoxylated alcohols, and amides; cationic surfactants such as ethoxylated quaternary ammonium salts like alkyl aryl dimethyl ammonium chlorides and dialkyl dimethyl ammonium chlorides; anionic surfactants such as alkyl sulfate salts, alkylbenzene or alkyltoluene sulfonates, or alkyl ether sulfates; and combinations thereof. In some embodiments, the silica, if present, is used in some inventive embodiments in an amount of between 1 and 15 dry weight percent.

pH buffers operative herein illustratively include a conjugate weak acid or weak base of either the first phosphate salt, the second phosphate salt, or a combination thereof present in the aqueous solution of the inventive composition.

An inventive composition is stored as a dry powder and provided with instructions as to how to dissolve in water to a specified concentration. In other inventive embodiments, a solution concentrate is provided. Typically, a concentrate is diluted to 10 to 500 times to form a solution of usage. In still other embodiments, the inventive composition is provided as a ready to use, fully diluted solution that contains from 0.1 to 5 total weight percent of the solution of the inventive composition.

A process of protecting an iron containing metal from corrosion involves the exposure of the metal to an inventive solution. Through the monitoring of corrosion of the metal over time, the corrosion protection of the metal is assured. The solution being replenished when the monitoring indicates that the corrosion of the metal exceeds a preselected threshold.

It is appreciated that upon preparing a solution, still further amounts of the aforementioned additives are added to the solution. Co-solvents miscible with water are also provided in some inventive embodiments. Co-solvents operative herein illustratively include amine solvents such pyridine, piperidine, collidine, ethylenediamine, quinolone, diethylenetriamine, monoethanolamine, triethanolamine, diglycolamine, diisopropanolamine, 2-amino-2-methyl-1-propanol and combinations thereof.

EXAMPLES

The present invention is further detailed with respect to the following non-limiting examples.

A cast iron chips having a total weight of 1 gram are placed in a solution normalized to 1 total weight percent of salt in deionized (DI) water. A 55 mm Whatman 40 ashless filter paper is trimmed to fit into a 50 mm pyrex petri dish. The petri dish containing the filter paper is placed onto a digital scale. 1.00 grams of ASTM D4627-97 cast iron chips are weighed onto the filter paper in the petri dish. 1.00 gram of sample solution is then dripped onto the cast iron chips. The petri dish is then allowed to sit undisturbed at room temperature until all of the sample solution has evaporated. The cast iron chips and filter paper are then examined for corrosion. An estimate of the amount of corrosion (0-100%) is made by examining the filter paper and determining how much area of the filter paper displays rust compared to the area of filter paper the cast iron chips occupied. The pH of the solution upon preparation and before insertion of the cast iron chips is recorded along with the percent corrosion as determined by weight loss of iron, as measured by iron oxide accumulation on tared filter paper. The results are summarized in Table 1. As a comparison sodium tetraborate decahydrate at the same 1 total weight percent had a pH of 9.25 and a corrosion weight loss of 5-10%. Sodium tripolyphosphate (low density, technical grade) present at 0.93 total weight percent and sodium carbonate at 0.07% in DI water had a pH of 10.99 and a corrosion weight loss of 40-50%. DI water itself as a control has a pH of 4.84 and a corrosion weight loss of 100%.

Table 1. Percent corrosion and solution pH for 1 total weight percent of specific phosphate salts in DI water including Sodium tripolyphosphate (low density, technical grade) (abbreviated as STPP LD TG) three different grades/sources of disodium phosphate anhydrous (DSPA), sodium hexametaphosphate (SHMP) granular, dipotassium phosphate (DPP) granular, tetrapotassium pyrophosphate (TPPP) granular, potassium tripoly-phosphate (KTPP), diammonium phosphate (DAP) granular, sodium tetraborate decahydrate (prior art), and Competitor product (sodium tripolyphosphate and sodium carbonate).

TABLE 1

Percent corrosion and solution pH for 1 total weight percent of specific phosphate salts in DI water including Sodium tripolyphosphate (low density, technical grade) (abbreviated as STPP LD TG) three different grades/sources of disodium phosphate anhydrous (DSPA), sodium hexametaphosphate (SHMP) granular, dipotassium phosphate (DPP) granular, tetrapotassium pyrophosphate (TPPP) granular, potassium tripoly-phosphate (KTPP), diammonium phosphate (DAP) granular, sodium tetraborate decahydrate (prior art), and Competitor product (sodium tripolyphosphate and sodium carbonate).

| Sample id | STPP LD TG (Granular,) | DSPA (Granular, ICL) | DSPA (Granular, Innophos) | DSPA (Powder, Innophos) | Total | pH | % Corrosion |
|---|---|---|---|---|---|---|---|
| 1 | | 1.00% | | | 1.00% | 9.52 | 10-20% |
| 2 | 0.05% | 0.95% | | | 1.00% | 9.53 | 10-20% |
| 3 | 0.10% | 0.90% | | | 1.00% | 9.54 | 20-30% |
| 4 | 0.15% | 0.85% | | | 1.00% | 9.57 | 10-20% |
| 5 | 0.20% | 0.80% | | | 1.00% | 9.59 | 5-10% |
| 6 | 0.25% | 0.75% | | | 1.00% | 9.62 | 10-20% |
| 7 | 0.30% | 0.70% | | | 1.00% | 9.62 | 5-10% |
| 8 | 0.35% | 0.65% | | | 1.00% | 9.65 | 10-20% |
| 9 | 0.40% | 0.60% | | | 1.00% | 9.68 | 10-20% |
| 10 | 0.45% | 0.55% | | | 1.00% | 9.69 | 5-10% |
| 11 | 0.50% | 0.50% | | | 1.00% | 9.71 | 0.00% |
| 12 | 0.55% | 0.45% | | | 1.00% | 9.73 | 0.00% |
| 13 | 0.60% | 0.40% | | | 1.00% | 9.76 | 0.00% |
| 14 | 0.65% | 0.35% | | | 1.00% | 9.79 | 0.00% |
| 15 | 0.70% | 0.30% | | | 1.00% | 9.81 | 0.00% |
| 16 | 0.75% | 0.25% | | | 1.00% | 9.83 | 0.00% |
| 17 | 0.80% | 0.20% | | | 1.00% | 9.86 | 0.00% |
| 18 | 0.85% | 0.15% | | | 1.00% | 9.89 | 0-5% |
| 19 | 0.90% | 0.10% | | | 1.00% | 9.92 | 40-50% |
| 20 | 0.95% | 0.05% | | | 1.00% | 9.95 | 50-60% |
| 21 | 1.00% | | | | 1.00% | 9.98 | 70-80% |
| 22 | | | 1.00% | | 1.00% | 9.33 | 20-30% |
| 23 | 0.05% | | 0.95% | | 1.00% | 9.39 | 10-20% |
| 24 | 0.10% | | 0.90% | | 1.00% | 9.43 | 10-20% |
| 25 | 0.15% | | 0.85% | | 1.00% | 9.46 | 10-20% |
| 26 | 0.20% | | 0.80% | | 1.00% | 9.5 | 10-20% |
| 27 | 0.25% | | 0.75% | | 1.00% | 9.53 | 5-10% |
| 28 | 0.30% | 0.70% | | | 1.00% | 9.56 | 5-10% |
| 29 | 0.35% | 0.65% | | | 1.00% | 9.59 | 0.00% |
| 30 | 0.40% | 0.60% | | | 1.00% | 9.62 | 0.00% |
| 31 | 0.45% | 0.55% | | | 1.00% | 9.65 | 0.00% |
| 32 | 0.50% | 0.50% | | | 1.00% | 9.68 | 0.00% |
| 33 | 0.55% | 0.45% | | | 1.00% | 9.69 | 0.00% |
| 34 | 0.60% | 0.40% | | | 1.00% | 9.74 | 0.00% |
| 35 | 0.65% | 0.35% | | | 1.00% | 9.77 | 0.00% |
| 36 | 0.70% | 0.30% | | | 1.00% | 9.79 | 0.00% |
| 37 | 0.75% | 0.25% | | | 1.00% | 9.74 | 0.00% |
| 38 | 0.80% | 0.20% | | | 1.00% | 9.8 | 0.00% |
| 39 | 0.85% | 0.15% | | | 1.00% | 9.85 | 10-20% |
| 40 | 0.90% | 0.10% | | | 1.00% | 9.86 | 20-30% |
| 41 | 0.95% | 0.05% | | | 1.00% | 9.91 | 50-60% |
| 42 | 1.00% | | | | 1.00% | 9.94 | 50-60% |
| 43 | | | 1.00% | | 1.00% | 9.39 | 20-30% |
| 44 | 0.05% | | 0.95% | | 1.00% | 9.46 | 10-20% |
| 45 | 0.10% | | 0.90% | | 1.00% | 9.51 | 10-20% |
| 46 | 0.15% | | 0.85% | | 1.00% | 9.54 | 10-20% |
| 47 | 0.20% | | 0.80% | | 1.00% | 9.58 | 10-20% |
| 48 | 0.25% | | 0.75% | | 1.00% | 9.61 | 10-20% |
| 49 | 0.30% | | 0.70% | | 1.00% | 9.64 | 5-10% |
| 50 | 0.35% | | 0.65% | | 1.00% | 9.65 | 5-10% |
| 51 | 0.40% | | 0.60% | | 1.00% | 9.69 | 0-5% |
| 52 | 0.45% | | 0.55% | | 1.00% | 9.54 | 5-10% |
| 53 | 0.50% | | 0.50% | | 1.00% | 9.55 | 0.00% |
| 54 | 0.55% | | 0.45% | | 1.00% | 9.59 | 0.00% |
| 55 | 0.60% | | 0.40% | | 1.00% | 9.62 | 0.00% |
| 56 | 0.65% | | 0.35% | | 1.00% | 9.63 | 0.00% |
| 57 | 0.70% | | 0.30% | | 1.00% | 9.64 | 0.00% |
| 58 | 0.75% | | 0.25% | | 1.00% | 9.69 | 0-5% |
| 59 | 0.80% | | 0.20% | | 1.00% | 9.71 | 5-10% |
| 60 | 0.85% | | 0.15% | | 1.00% | 9.73 | 10-20% |
| 61 | 0.90% | | 0.10% | | 1.00% | 9.76 | 30-40% |

TABLE 1-continued

Percent corrosion and solution pH for 1 total weight percent of specific phosphate salts in DI water including Sodium tripolyphosphate (low density, technical grade) (abbreviated as STPP LD TG) three different grades/sources of disodium phosphate anhydrous (DSPA), sodium hexametaphosphate (SHMP) granular, dipotassium phosphate (DPP) granular, tetrapotassium pyrophosphate (TPPP) granular, potassium tripoly-phosphate (KTPP), diammonium phosphate (DAP) granular, sodium tetraborate decahydrate (prior art), and Competitor product (sodium tripolyphosphate and sodium carbonate).

| | | | | | | | | | | |
|---|---|---|---|---|---|---|---|---|---|---|
| 62 | 0.95% | | | | 0.05% | | | 1.00% | 9.79 | 50-60% |
| 63 | 1.00% | | | | | | | 1.00% | 9.81 | 50-60% |
| Sample id | STPP LD TG (Gran) | DSPA (Gran., Supplier 1) | DSPA (Gran., Supplier 2) | DSPA (Powder) | D.I. Water | SHMP Gran. | DPP Gran. | TPPP Gran. | TSPP Gran. | KTPP |
| 64 | 0.25% | | | | 99.00% | 0.75% | | | | |
| 65 | 0.50% | | | | 99.00% | 0.50% | | | | |
| 66 | 0.75% | | | | 99.00% | 0.25% | | | | |
| 67 | | | 0.25% | | 99.00% | 0.75% | | | | |
| 68 | | | 0.50% | | 99.00% | 0.50% | | | | |
| 69 | | | 0.75% | | 99.00% | 0.25% | | | | |
| 70 | 0.25% | | | | 99.00% | | 0.75% | | | |
| 71 | 0.50% | | | | 99.00% | | 0.50% | | | |
| 72 | 0.75% | | | | 99.00% | | 0.25% | | | |
| 73 | | | 0.25% | | 99.00% | | 0.75% | | | |
| 74 | | | 0.50% | | 99.00% | | 0.50% | | | |
| 75 | | | 0.75% | | 99.00% | | 0.25% | | | |
| 76 | 0.25% | | | | 99.00% | | | 0.75% | | |
| 77 | 0.50% | | | | 99.00% | | | 0.50% | | |
| 78 | 0.75% | | | | 99.00% | | | 0.25% | | |
| 79 | | | 0.25% | | 99.00% | | | 0.75% | | |
| 80 | | | 0.50% | | 99.00% | | | 0.50% | | |
| 81 | | | 0.75% | | 99.00% | | | 0.25% | | |
| 82 | | | 0.00% | | 99.00% | | | | 1.00% | |
| 83 | | | 0.10% | | 99.00% | | | | 0.90% | |
| 84 | | | 0.20% | | 99.00% | | | | 0.80% | |
| 85 | | | 0.30% | | 99.00% | | | | 0.70% | |
| 86 | | | 0.40% | | 99.00% | | | | 0.60% | |
| 87 | | | 0.50% | | 99.00% | | | | 0.50% | |
| 88 | | | 0.60% | | 99.00% | | | | 0.40% | |
| 89 | | | 0.70% | | 99.00% | | | | 0.30% | |
| 90 | | | 0.80% | | 99.00% | | | | 0.20% | |
| 91 | | | 0.90% | | 99.00% | | | | 0.10% | |
| 92 | 0.10% | | | | 99.00% | | | | 0.90% | |
| 93 | 0.20% | | | | 99.00% | | | | 0.80% | |
| 94 | 0.30% | | | | 99.00% | | | | 0.70% | |
| 95 | 0.40% | | | | 99.00% | | | | 0.60% | |
| 96 | 0.50% | | | | 99.00% | | | | 0.50% | |
| 97 | 0.60% | | | | 99.00% | | | | 0.40% | |
| 98 | 0.70% | | | | 99.00% | | | | 0.30% | |
| 99 | 0.80% | | | | 99.00% | | | | 0.20% | |
| 100 | 0.90% | | | | 99.00% | | | | 0.10% | |
| 101 | | | 0.10% | | 99.00% | | | | | 0.90% |
| 102 | | | 0.20% | | 99.00% | | | | | 0.80% |
| 103 | | | 0.30% | | 99.00% | | | | | 0.70% |
| 104 | | | 0.40% | | 99.00% | | | | | 0.60% |
| 105 | | | 0.50% | | 99.00% | | | | | 0.50% |
| 106 | | | 0.60% | | 99.00% | | | | | 0.40% |
| 107 | | | 0.70% | | 99.00% | | | | | 0.30% |
| 108 | | | 0.80% | | 99.00% | | | | | 0.20% |
| 109 | | | 0.90% | | 99.00% | | | | | 0.10% |
| 110 | | | 0.00% | | 99.00% | | | | | 1.00% |
| 111 | 0.00% | | | | 99.00% | | | | | |
| 112 | 0.10% | | | | 99.00% | | | | | |
| 113 | 0.20% | | | | 99.00% | | | | | |
| 114 | 0.30% | | | | 99.00% | | | | | |
| 115 | 0.40% | | | | 99.00% | | | | | |
| 116 | 0.50% | | | | 99.00% | | | | | |
| 117 | 0.60% | | | | 99.00% | | | | | |
| 118 | 0.70% | | | | 99.00% | | | | | |
| 119 | 0.80% | | | | 99.00% | | | | | |
| 120 | 0.90% | | | | 99.00% | | | | | |
| 121 | | | 0.10% | | 99.00% | | | | | |
| 122 | | | 0.20% | | 99.00% | | | | | |
| 123 | | | 0.30% | | 99.00% | | | | | |
| 124 | | | 0.40% | | 99.00% | | | | | |
| 125 | | | 0.50% | | 99.00% | | | | | |
| 126 | | | 0.60% | | 99.00% | | | | | |

TABLE 1-continued

Percent corrosion and solution pH for 1 total weight percent of specific phosphate salts in DI water including Sodium tripolyphosphate (low density, technical grade) (abbreviated as STPP LD TG) three different grades/sources of disodium phosphate anhydrous (DSPA), sodium hexametaphosphate (SHMP) granular, dipotassium phosphate (DPP) granular, tetrapotassium pyrophosphate (TPPP) granular, potassium tripoly-phosphate (KTPP), diammonium phosphate (DAP) granular, sodium tetraborate decahydrate (prior art), and Competitor product (sodium tripolyphosphate and sodium carbonate).

| | | | | | | | | | |
|---|---|---|---|---|---|---|---|---|---|
| 127 | | 0.70% | 99.00% | | | | | | |
| 128 | | 0.80% | 99.00% | | | | | | |
| 129 | | 0.90% | 99.00% | | | | | | |
| Sample id | DAP Gran. | STD Inv. | Comp Prod (STPP + SC) | TCP | SPPP | STMP | Total | pH | % Corrosion |
| 64 | | | | | | | 100.00% | 7.88 | 90-100% |
| 65 | | | | | | | 100.00% | 8.56 | 90-100% |
| 66 | | | | | | | 100.00% | 9.02 | 90-100% |
| 67 | | | | | | | 100.00% | 7.45 | 90-100% |
| 68 | | | | | | | 100.00% | 7.81 | 20-30% |
| 69 | | | | | | | 100.00% | 8.25 | 20-30% |
| 70 | | | | | | | 100.00% | 9.49 | 20-30% |
| 71 | | | | | | | 100.00% | 9.63 | 0.00% |
| 72 | | | | | | | 100.00% | 9.74 | 0.00% |
| 73 | | | | | | | 100.00% | 9.24 | 30-40% |
| 74 | | | | | | | 100.00% | 9.22 | 30-40% |
| 75 | | | | | | | 100.00% | 9.23 | 10-20% |
| 76 | | | | | | | 100.00% | 10.23 | 0.00% |
| 77 | | | | | | | 100.00% | 9.95 | 10-20% |
| 78 | | | | | | | 100.00% | 9.72 | 50-60% |
| 79 | | | | | | | 100.00% | 10.13 | 0.00% |
| 80 | | | | | | | 100.00% | 9.95 | 0.00% |
| 81 | | | | | | | 100.00% | 9.71 | 5-10% |
| 82 | | | | | | | 100.00% | 10.44 | 10-20% |
| 83 | | | | | | | 100.00% | 10.33 | 0.00% |
| 84 | | | | | | | 100.00% | 10.2 | 0.00% |
| 85 | | | | | | | 100.00% | 10.11 | 0.00% |
| 86 | | | | | | | 100.00% | 10.01 | 0.00% |
| 87 | | | | | | | 100.00% | 9.94 | 0.00% |
| 88 | | | | | | | 100.00% | 9.85 | 0.00% |
| 89 | | | | | | | 100.00% | 9.75 | 0.00% |
| 90 | | | | | | | 100.00% | 9.66 | 0.00% |
| 91 | | | | | | | 100.00% | 9.51 | 0-5% |
| 92 | | | | | | | 100.00% | 10.34 | 20-30% |
| 93 | | | | | | | 100.00% | 10.33 | 20-30% |
| 94 | | | | | | | 100.00% | 10.27 | 20-30% |
| 95 | | | | | | | 100.00% | 10.23 | 20-30% |
| 96 | | | | | | | 100.00% | 10.18 | 30-40% |
| 97 | | | | | | | 100.00% | 10.13 | 40-50% |
| 98 | | | | | | | 100.00% | 10.08 | 40-50% |
| 99 | | | | | | | 100.00% | 10 | 40-50% |
| 100 | | | | | | | 100.00% | 9.93 | 40-50% |
| 101 | | | | | | | 100.00% | 9.64 | 20-30% |
| 102 | | | | | | | 100.00% | 8.5 | 0.00% |
| 103 | | | | | | | 100.00% | 8.54 | 0.00% |
| 104 | | | | | | | 100.00% | 9.48 | 5-10% |
| 105 | | | | | | | 100.00% | 9.45 | 10-20% |
| 106 | | | | | | | 100.00% | 9.39 | 20-30% |
| 107 | | | | | | | 100.00% | 9.36 | 20-30% |
| 108 | | | | | | | 100.00% | 9.29 | 20-30% |
| 109 | | | | | | | 100.00% | 9.26 | 20-30% |
| 110 | | | | | | | 100.00% | 9.69 | 50-60% |
| 111 | 1.00% | | | | | | 100.00% | 8.03 | 50-60% |
| 112 | 0.90% | | | | | | 100.00% | 8.05 | 70-80% |
| 113 | 0.80% | | | | | | 100.00% | 8.09 | 70-80% |
| 114 | 0.70% | | | | | | 100.00% | 8.19 | 60-70% |
| 115 | 0.60% | | | | | | 100.00% | 8.25 | 30-40% |
| 116 | 0.50% | | | | | | 100.00% | 8.35 | 0.00% |
| 117 | 0.40% | | | | | | 100.00% | 8.45 | 0.00% |
| 118 | 0.30% | | | | | | 100.00% | 8.59 | 0.00% |
| 119 | 0.20% | | | | | | 100.00% | 8.76 | 0.00% |
| 120 | 0.10% | | | | | | 100.00% | 8.99 | 5-10% |
| 121 | 0.90% | | | | | | 100.00% | 8.04 | 90-100% |
| 122 | 0.80% | | | | | | 100.00% | 8.07 | 90-100% |
| 123 | 0.70% | | | | | | 100.00% | 8.09 | 90-100% |
| 124 | 0.60% | | | | | | 100.00% | 8.14 | 70-80% |
| 125 | 0.50% | | | | | | 100.00% | 8.18 | 70-80% |
| 126 | 0.40% | | | | | | 100.00% | 8.23 | 50-60% |

TABLE 1-continued

Percent corrosion and solution pH for 1 total weight percent of specific phosphate salts in DI water including Sodium tripolyphosphate (low density, technical grade) (abbreviated as STPP LD TG) three different grades/sources of disodium phosphate anhydrous (DSPA), sodium hexametaphosphate (SHMP) granular, dipotassium phosphate (DPP) granular, tetrapotassium pyrophosphate (TPPP) granular, potassium tripoly-phosphate (KTPP), diammonium phosphate (DAP) granular, sodium tetraborate decahydrate (prior art), and Competitor product (sodium tripolyphosphate and sodium carbonate).

| | | | | | | | | | |
|---|---|---|---|---|---|---|---|---|---|
| 127 | 0.30% | | | | | | 100.00% | 8.29 | 50-60% |
| 128 | 0.20% | | | | | | 100.00% | 8.39 | 30-40% |
| 129 | 0.10% | | | | | | 100.00% | 8.53 | 20-30% |

| Sample id | STPP LD TG (Gran.) | DSPA (Granular, Supplier 2) | D.I. Water | Tricalcium Phosphate (TCP) | (SPPP) | Sodium Trimetaphospate (STMP) | Total | pH | % Corrosion |
|---|---|---|---|---|---|---|---|---|---|
| 130 | 99.00% | | 99.00% | 1.00% | | | | | |
| 131 | 0.10% | | 99.00% | 0.90% | | | 100.00% | Insoluble | |
| 132 | 0.20% | | 99.00% | 0.80% | | | 100.00% | Insoluble | |
| 133 | 0.30% | | 99.00% | 0.70% | | | 100.00% | Insoluble | |
| 134 | 0.40% | | 99.00% | 0.60% | | | 100.00% | Insoluble | |
| 135 | 0.50% | | 99.00% | 0.50% | | | 100.00% | Insoluble | |
| 136 | 0.60% | | 99.00% | 0.40% | | | 100.00% | Insoluble | |
| 137 | 0.70% | | 99.00% | 0.30% | | | 100.00% | Insoluble | |
| 138 | 0.80% | | 99.00% | 0.20% | | | 100.00% | Insoluble | |
| 139 | 0.90% | | 99.00% | 0.10% | | | 100.00% | Insoluble | |
| 140 | | 0.10% | 99.00% | | 0.90% | | 100.00% | 8.48 | 90-100% |
| 141 | | 0.20% | 99.00% | | 0.80% | | 100.00% | 8.48 | 50-60% |
| 142 | | 0.30% | 99.00% | | 0.70% | | 100.00% | 8.5 | 0-5% |
| 143 | | 0.40% | 99.00% | | 0.60% | | 100.00% | 8.52 | 10-20% |
| 144 | | 0.50% | 99.00% | | 0.50% | | 100.00% | 8.56 | 0-5% |
| 145 | | 0.60% | 99.00% | | 0.40% | | 100.00% | 8.61 | 20-30% |
| 146 | | 0.70% | 99.00% | | 0.30% | | 100.00% | 8.66 | 20-30% |
| 147 | | 0.80% | 99.00% | | 0.20% | | 100.00% | 8.75 | 30-40% |
| 148 | | 0.90% | 99.00% | | 0.10% | | 100.00% | 8.97 | 20-30% |
| 149 | | 0.00% | 99.00% | | 1.00% | | 100.00% | 8.44 | 90-100% |
| 150 | 0.10% | | 99.00% | | | 0.90% | 100.00% | 8.55 | 90-100% |
| 151 | 0.20% | | 99.00% | | | 0.80% | 100.00% | 8.92 | 90-100% |
| 152 | 0.30% | | 99.00% | | | 0.70% | 100.00% | 9.12 | 90-100% |
| 153 | 0.40% | | 99.00% | | | 0.60% | 100.00% | 9.28 | 90-100% |
| 154 | 0.50% | | 99.00% | | | 0.50% | 100.00% | 9.41 | 90-100% |
| 155 | 0.60% | | 99.00% | | | 0.40% | 100.00% | 9.5 | 90-100% |
| 156 | 0.70% | | 99.00% | | | 0.30% | 100.00% | 9.57 | 90-100% |
| 157 | 0.80% | | 99.00% | | | 0.20% | 100.00% | 9.67 | 70-80% |
| 158 | 0.90% | | 99.00% | | | 0.10% | 100.00% | 9.75 | 90-100% |
| 159 | 0.00% | | 99.00% | | | 1.00% | 100.00% | 6.59 | 90-100% |
| 160 | | 0.10% | 99.00% | | | 0.90% | 100.00% | 7.98 | 90-100% |
| 161 | | 0.20% | 99.00% | | | 0.80% | 100.00% | 8.3 | 90-100% |
| 162 | | 0.30% | 99.00% | | | 0.70% | 100.00% | 8.44 | 90-100% |
| 163 | | 0.40% | 99.00% | | | 0.60% | 100.00% | 8.61 | 90-100% |
| 164 | | 0.50% | 99.00% | | | 0.50% | 100.00% | 8.73 | 90-100% |
| 165 | | 0.60% | 99.00% | | | 0.40% | 100.00% | 8.85 | 90-100% |
| 166 | | 0.70% | 99.00% | | | 0.30% | 100.00% | 8.92 | 90-100% |
| 167 | | 0.80% | 99.00% | | | 0.20% | 100.00% | 9.05 | 40-50% |
| 168 | | 0.90% | 99.00% | | | 0.10% | 100.00% | 9.13 | 40-50% |

Abbreviations in Table 1.

Gran.—granular
SHMP—Sodium Hexametaphosphate.
DPP—Dipotassium Phosphate
TPPP—Tetrapotassium Pyrophosphate
TSPP—Tetrasodium Pyrophosphate
KTPP—Potassium Tripolyphosphate
DAP—Diammonium Phosphate
TCP—Tricalcium Phosphate
SPPP—Sodium Pentapoly-phosphate
STMP—Sodium Trimetaphosphate
STD—Sodium Tetraborate Decahydrate
Inv.—Current chemistry
Comp.—Competitor
Prod.—Product
STPP—Sodium Tripolyphosphate
SC—Sodium Carbonate
Corsn.—Corrosion Neither the sodium tripolyphosphate (STPP) nor the disodium phosphate anhydrous (DSPA) is a particular good corrosion inhibitor, as noted for sample IDs 1, 22, 43, and 63. A synergistic relationship between STPP:DSPA is noted in Sample IDs 11-17, 29-38, 53-57, 71, 72, 76, 79, 80, 83-90, 102, 103, 116-119, 142, and 144 corresponding to a weight ratio 1-4:1 and having a pH of 9.8 or less provides better corrosion protection than solutions outside of this range. The inventive compositions of Table 1 are noted to also be superior to sodium tetraborate decahydrate.

As noted in Table 1, synergistic corrosion inhibition is noted between the phosphate pairs of: sodium tripolyphosphate and dipotassium phosphate, sodium tripolyphosphate and disodium phosphate, sodium tripolyphosphate and tetrapotassium pyrophosphate, disodium phosphate and tetrapotassium pyrophosphate, disodium phosphate and tetrasodium pyrophosphate, disodium phosphate and potassium tripolyphosphate, sodium tripolyphosphate and diammonium phosphate.

A composition according to samples 11-17, 29-38, 53-57, 71, 72, 76, 79, 80, 83-90, 102, 103, 116-119, 142, or 144 are admixed as a replacement to borax in dry mix formulas of fluorescent magnetic powder and water conditioner. The resulting products perform similarly relative to the base products.

The foregoing description is illustrative of particular embodiments of the invention, but is not meant to be a limitation upon the practice thereof. The following claims, including all equivalents thereof, are intended to define the scope of the invention.

The invention claimed is:

1. A composition with corrosion inhibiting properties comprising:

a first phosphate salt of at least one of disodium phosphate trimetaphosphate, or sodium tripolyphosphate; and a second phosphate salt of at least one of a divalent phosphate, disodium phosphate, or tetravalent pyrophosphate, said first phosphate salt present in a weight ratio relative to said second phosphate salt of from 1-4:1, the composition when dissolved at 1 percent by weight in deionized water has a pH of between 9.5 and 9.8; and wherein the second phosphate salt is disodium phosphate when the first phosphate is sodium tripolyphosphate; said first phosphate salt and said second phosphate salt forming a concentrate or a dried residue of an aqueous solution wherein in combination said first phosphate salt and said second phosphate salt are present together from 90 to 100 total weight percent of the concentrate or the dried residue of the aqueous solution.

2. The composition of claim 1 wherein said first phosphate salt is a sodium salt.

3. The composition of claim 1 wherein said second phosphate salt a sodium salt.

4. The composition of claim 1 wherein said first phosphate salt is only tripolyphosphate.

5. The composition of claim 1 wherein said second phosphate salt is only said disodium phosphate.

6. The composition of claim 5 wherein said disodium phosphate is disodium phosphate anhydrous.

7. The composition of claim 1 further comprising an additive that is at least one of sodium silicate, a metal chloride, ceramic silicates, silicas, polymers, or a pH buffers.

8. The composition of claim 7 wherein said pH buffer is present.

* * * * *